US008128582B1

(12) United States Patent
Wu

(10) Patent No.: US 8,128,582 B1
(45) Date of Patent: Mar. 6, 2012

(54) BACK MASSAGING DEVICE

(76) Inventor: Dong-Her Wu, Chang Hua Hsien (TW)

( * ) Notice: Subject to any disclaimer, the term of this patent is extended or adjusted under 35 U.S.C. 154(b) by 803 days.

(21) Appl. No.: 12/257,619

(22) Filed: Oct. 24, 2008

(51) Int. Cl.
*A61H 7/00* (2006.01)
*A61H 19/00* (2006.01)
*A61H 15/00* (2006.01)

(52) U.S. Cl. ..... 601/99; 601/90; 601/98; 601/115

(58) Field of Classification Search ..... 601/24, 601/49, 67, 84, 86, 90, 94, 98, 99, 112, 115, 601/119
See application file for complete search history.

(56) References Cited

U.S. PATENT DOCUMENTS 5,179,940 A * 1/1993 Barreiro ..... 601/99
6,629,939 B2 * 10/2003 Jikiba et al. ..... 601/99
6,808,500 B1 * 10/2004 Cheng-Yi et al. ..... 601/99
6,991,609 B2 * 1/2006 Kan et al. ..... 601/99
7,022,092 B2 * 4/2006 Shimizu et al. ..... 601/99
7,083,582 B2 * 8/2006 Chen ..... 601/99
7,854,710 B2 * 12/2010 Liang ..... 601/98
2005/0090770 A1 * 4/2005 Chen ..... 601/99
2006/0206042 A1 * 9/2006 Chen ..... 601/99
2007/0055186 A1 * 3/2007 Hsieh ..... 601/99
2007/0299377 A1 * 12/2007 Shiraishi ..... 601/98

* cited by examiner

*Primary Examiner* — Kristen Matter
(74) *Attorney, Agent, or Firm* — Alan Kamrath; Kamrath IP Lawfirm, PA

(57) ABSTRACT

A back massaging device includes two eccentric rotation members each having an eccentric hole and a resting face, and two swing arms each provided with a mounting hole which has a sliding face. Thus, when each of the swing arms is pressed by the user's body, the sliding face of each of the swing arms is slidable on the resting face of the respective eccentric rotation member to freely adjust the angle of each of the swing arms, so that the first massaging member and the second massaging member of each of the swing arms touch the user's body evenly and exactly, and the pressing force applied by the first massaging member and the second massaging member are distributed evenly and smoothly on the user's body.

19 Claims, 12 Drawing Sheets

BACK MASSAGING DEVICE

BACKGROUND OF THE INVENTION

1. Field of the Invention

The present invention relates to a massaging device and, more particularly, to a massaging device for massaging a user's back to provide a comfortable sensation to the user.

2. Description of the Related Art

A conventional back massaging device in accordance with the prior art shown in FIGS. 11 and 12 comprises a driving mechanism 30 provided with a propeller shaft 31 which has two opposite ends each provided with an oblique drive portion 32 inclined relative to the propeller shaft 31, and two swing arms 40 each provided with a pivot hole 44 pivotally mounted on the respective oblique drive portion 32 of the propeller shaft 31 of the driving mechanism 30. Each of the two swing arms 40 has a first end provided with a first massaging member 41 and a second end provided with a second massaging member 42. The first massaging member 41 of each of the two swing arms 40 has a middle portion provided with an opening 43.

In operation, when the propeller shaft 31 of the driving mechanism 30 is rotated, the oblique drive portion 32 of the propeller shaft 31 of the driving mechanism 30 is rotated about the propeller shaft 31 of the driving mechanism 30 so that each of the two swing arms 40 is movable reciprocally by the respective oblique drive portion 32 of the propeller shaft 31 of the driving mechanism 30, and the first massaging member 41 and the second massaging member 42 of each of the two swing arms 40 are movable reciprocally to rub a user's body 2 so as to provide a massaging effect to the user's body 2.

However, the pivot hole 44 of each of the two swing arms 40 is directly mounted on the respective oblique drive portion 32 of the propeller shaft 31 of the driving mechanism 30, so that each of the two swing arms 40 is pivoted in a fixed angle. Thus, when the inclined angle of the user's body 2 does not fit the pivot angle of each of the two swing arms 40, only the first massaging member 41 or the second massaging member 42 of each of the two swing arms 40 touches the user's body 2, thereby decreasing the massaging effect of the massaging device.

BRIEF SUMMARY OF THE INVENTION

In accordance with the present invention, there is provided a massaging device, comprising two eccentric rotation members each having an inner portion provided with an eccentric hole and an outer portion provided with a resting face, and two swing arms each provided with a mounting hole which is pivotally mounted on a respective one of the two eccentric rotation members and has a peripheral wall provided with a sliding face which is in sliding contact with the resting face of the respective eccentric rotation member.

The primary objective of the present invention is to provide a massaging device, wherein the mounting hole of each of the two swing arms is pivotally mounted on the respective eccentric rotation member, so that each of the two swing arms is movable reciprocally with the respective eccentric rotation member, and the first massaging member and the second massaging member of each of the two swing arms are movable reciprocally to push, press and rub a user's body so as to provide a massaging effect to the user's body.

Another objective of the present invention is to provide a massaging device, wherein the sliding face of the mounting hole of each of the two swing arms is in frictional sliding contact with the resting face of the respective eccentric rotation member to freely change and adjust the angle of each of the two swing arms.

A further objective of the present invention is to provide a massaging device, wherein when each of the two swing arms is pressed by the user's body, the sliding face of the mounting hole of each of the two swing arms is slidable on the resting face of the respective eccentric rotation member to freely adjust the angle of each of the two swing arms, so that the first massaging member and the second massaging member of each of the two swing arms touch the user's body evenly and exactly, and the pressing force applied by the first massaging member and the second massaging member of each of the two swing arms are distributed evenly and smoothly on the user's body, thereby providing a comfortable sensation to the user.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
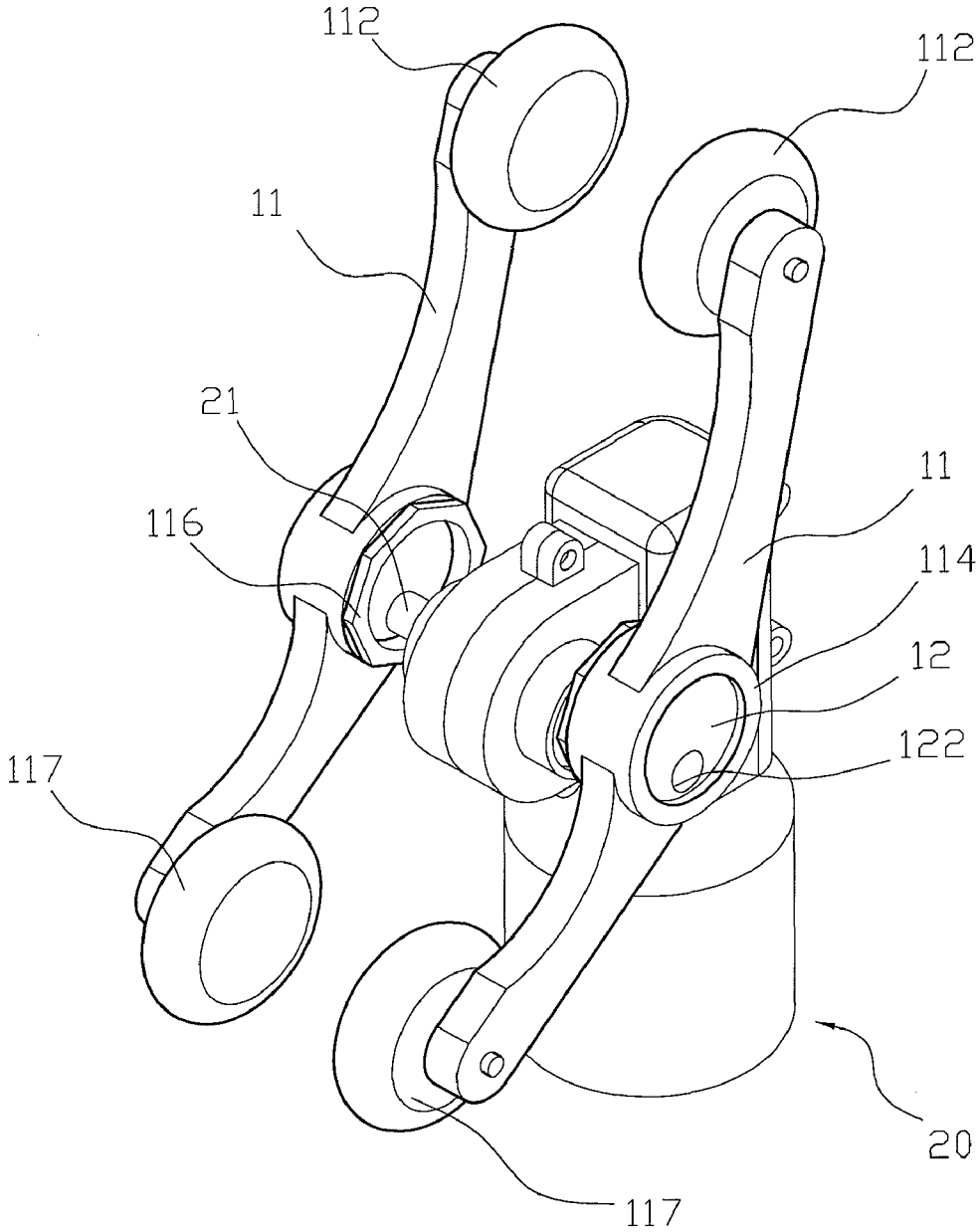
FIG. 1 is a perspective view of a massaging device in accordance with the preferred embodiment of the present invention.
Figure 2:
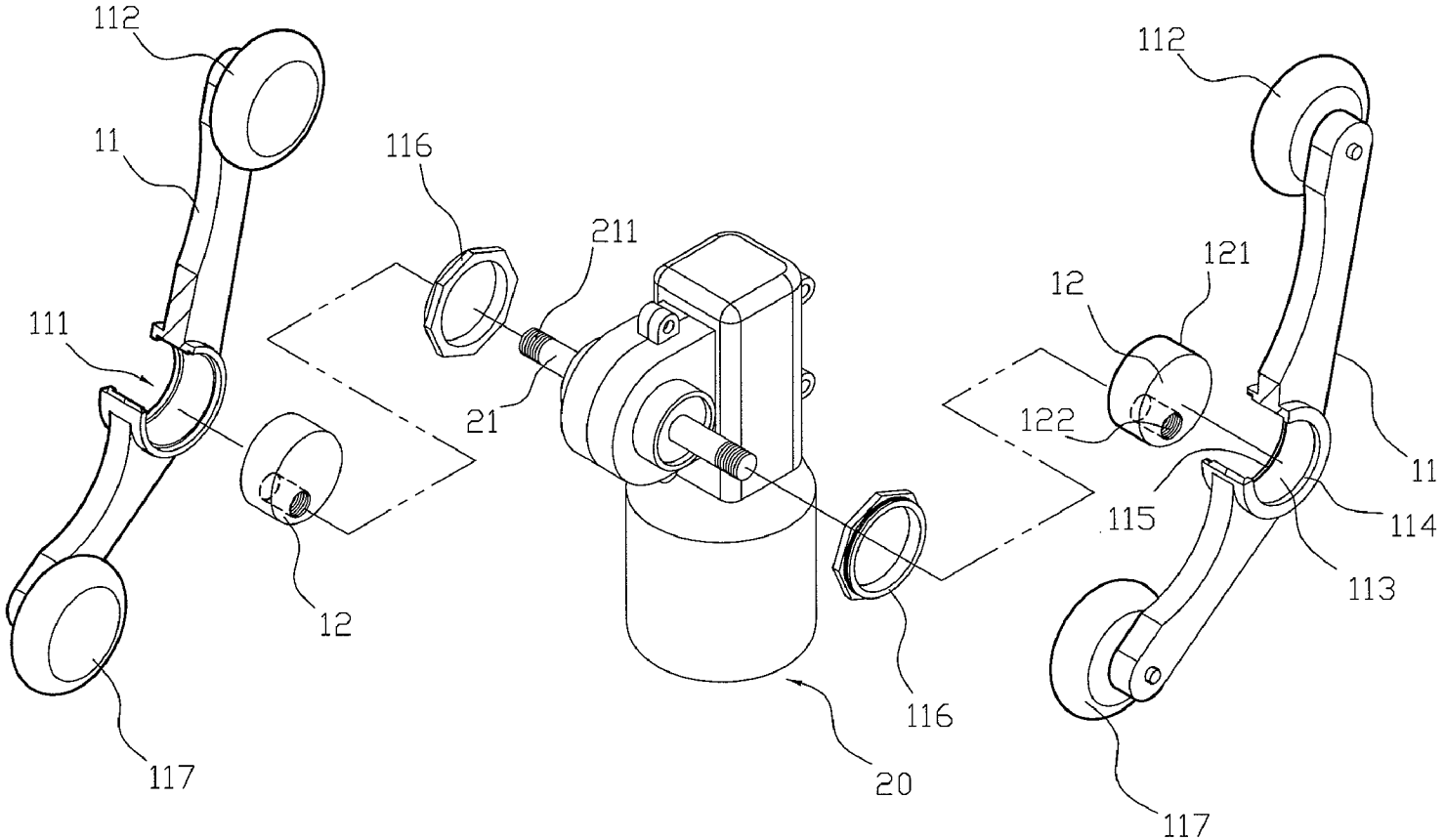
FIG. 2 is an exploded perspective view of the massaging device as shown in FIG. 1.

Referring to the drawings and initially to FIGS. 1 and 2, a back massaging device in accordance with the preferred embodiment of the present invention comprises two eccentric rotation members 12 each having an inner portion provided with an eccentric hole 122 and an outer portion provided with a resting face 121, and two swing arms 11 each provided with a mounting hole 111 which is pivotally mounted on a respective one of the two eccentric rotation members 12 and has a peripheral wall provided with a sliding face 113 which is in sliding contact with the resting face 121 of the respective eccentric rotation member 12.

Each of the two swing arms 11 has a first end provided with a first massaging member 112 and a second end provided with a second massaging member 117. The mounting hole 111 of each of the two swing arms 11 has a circular shape. The mounting hole 111 of each of the two swing arms 11 is located at a middle position of each of the two swing arms 11 and is located between the first massaging member 112 and the second massaging member 117. The mounting hole 111 of each of the two swing arms 11 has a first end provided with a radially and inwardly extending stop flange 114 and a second end provided with a fixing portion 115 for fixing a fixing member 116. The sliding face 113 of the mounting hole 111 of each of the two swing arms 11 is located between the stop flange 114 and the fixing portion 115. The sliding face 113 of the mounting hole 111 of each of the two swing arms 11 is a circular smooth flat face. The fixing portion 115 of the mounting hole 111 of each of the two swing arms 11 is combined with the fixing member 116 by a threading engagement.

Each of the two eccentric rotation members 12 is a bearing and has a circular shape. Each of the two eccentric rotation members 12 is inserted through the fixing portion 115 into the mounting hole 111 of the respective swing arm 11. Each of the two eccentric rotation members 12 is retained between the stop flange 114 and the fixing member 116 of the respective swing arm 11. The resting face 121 of each of the two eccentric rotation members 12 is a circular smooth flat face. The eccentric hole 122 of each of the two eccentric rotation members 12 is deflected from a central portion of each of the two eccentric rotation members 12. Preferably, the eccentric hole 122 of each of the two eccentric rotation members 12 is a screw bore.

The back massaging device further comprises a driving mechanism 20 provided with a propeller shaft 21 which has two opposite ends each provided with a drive portion 211. The drive portion 211 of the propeller shaft 21 of the driving mechanism 20 is in line and co-axial with the propeller shaft 21 of the driving mechanism 20. Each of the two eccentric rotation members 12 is fixed on and rotated by the propeller shaft 21 of the driving mechanism 20. Each of the two eccentric rotation members 12 is rotated about the eccentric hole 122 in an eccentric manner. The eccentric hole 122 of each of the two eccentric rotation members 12 is fixed on the respective drive portion 211 of the propeller shaft 21 of the driving mechanism 20 by a threading engagement.

Figure 3:
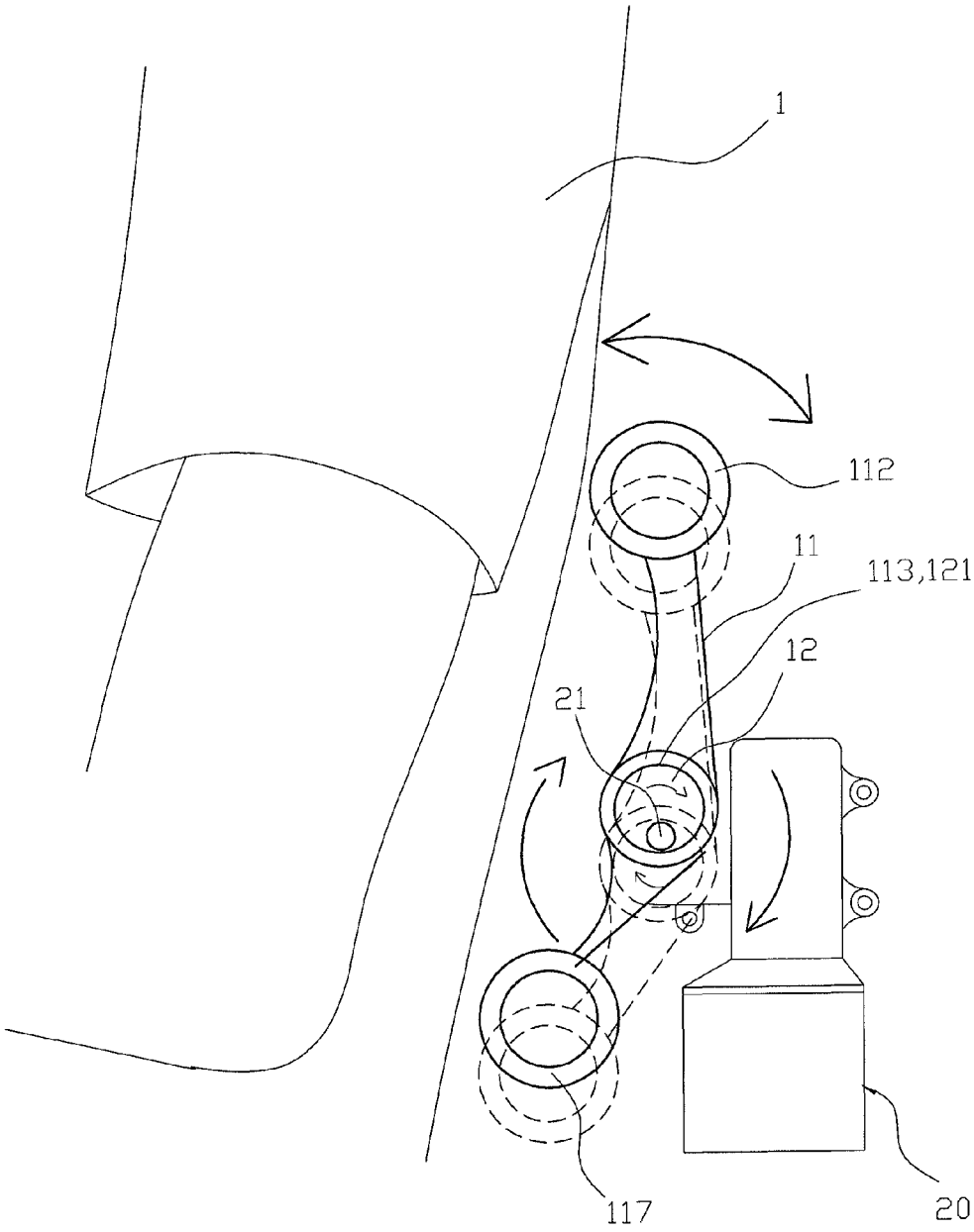
FIG. 3 is a side operational view of the massaging device as shown in FIG. 1 in use.
Figure 4:
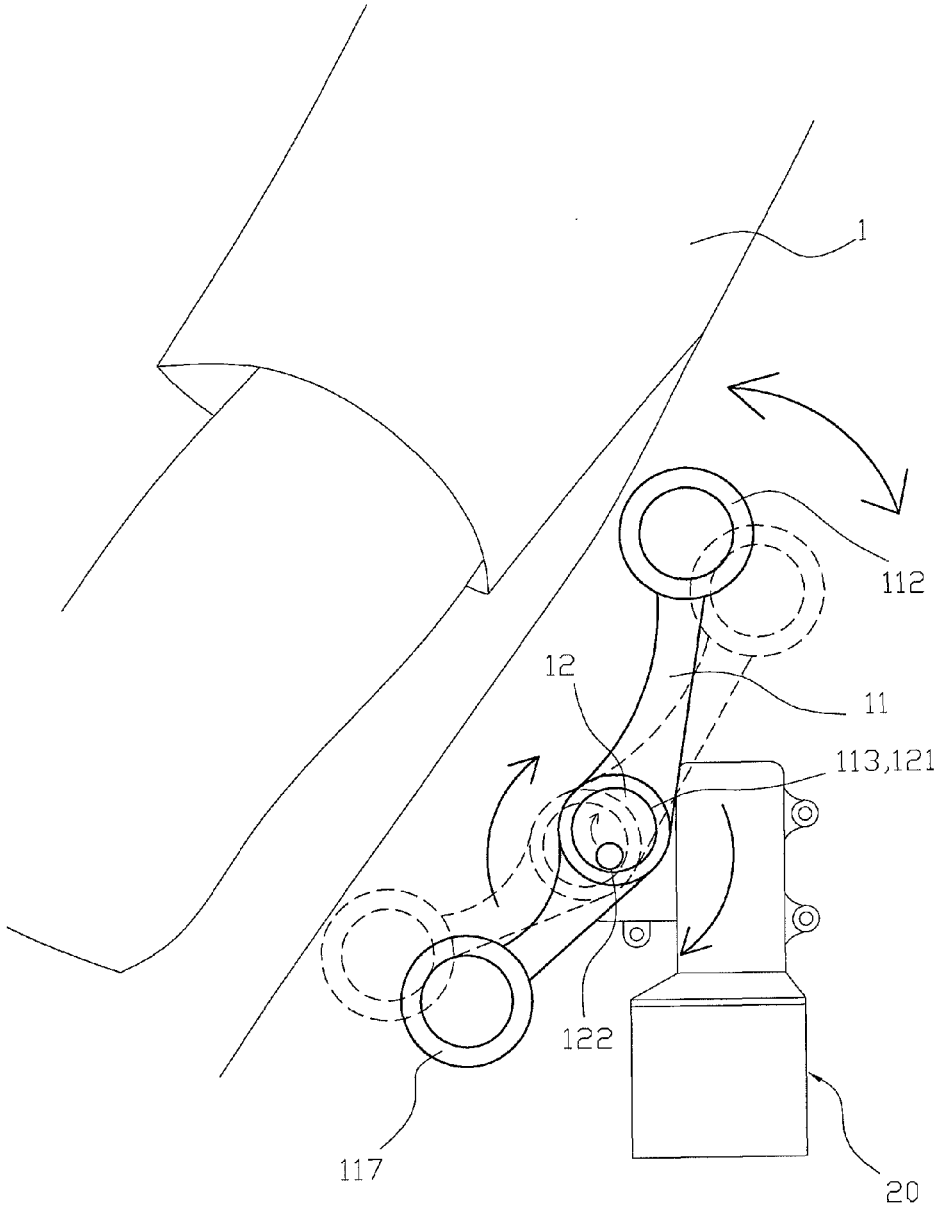
FIG. 4 is a side operational view of the massaging device as shown in FIG. 1 in use.

In operation, referring to FIGS. 3 and 4 with reference to FIGS. 1 and 2, when the propeller shaft 21 of the driving mechanism 20 is rotated, each of the two eccentric rotation members 12 is rotated about the eccentric hole 122 in an eccentric manner. At this time, the mounting hole 111 of each of the two swing arms 11 is pivotally mounted on the respective eccentric rotation member 12, so that each of the two swing arms 11 is movable reciprocally with the respective eccentric rotation member 12, and the first massaging member 112 and the second massaging member 117 of each of the two swing arms 11 are movable reciprocally to push, press and rub a user's body 1 so as to provide a massaging effect to the user's body 1.

In such a manner, the sliding face 113 of the mounting hole 111 of each of the two swing arms 11 is in frictional sliding contact with the resting face 121 of the respective eccentric rotation member 12 to freely change and adjust the angle of each of the two swing arms 11. Thus, when each of the two swing arms 11 is pressed by the user's body 1, the sliding face 113 of the mounting hole 111 of each of the two swing arms 11 is slidable on the resting face 121 of the respective eccentric rotation member 12 to freely adjust the angle of each of the two swing arms 11, so that the first massaging member 112 and the second massaging member 117 of each of the two swing arms 11 touch the user's body 1 evenly and exactly, and the pressing force applied by the first massaging member 112 and the second massaging member 117 of each of the two swing arms 11 are distributed evenly and smoothly on the user's body 1, thereby providing a comfortable sensation to the user.

Figure 5:
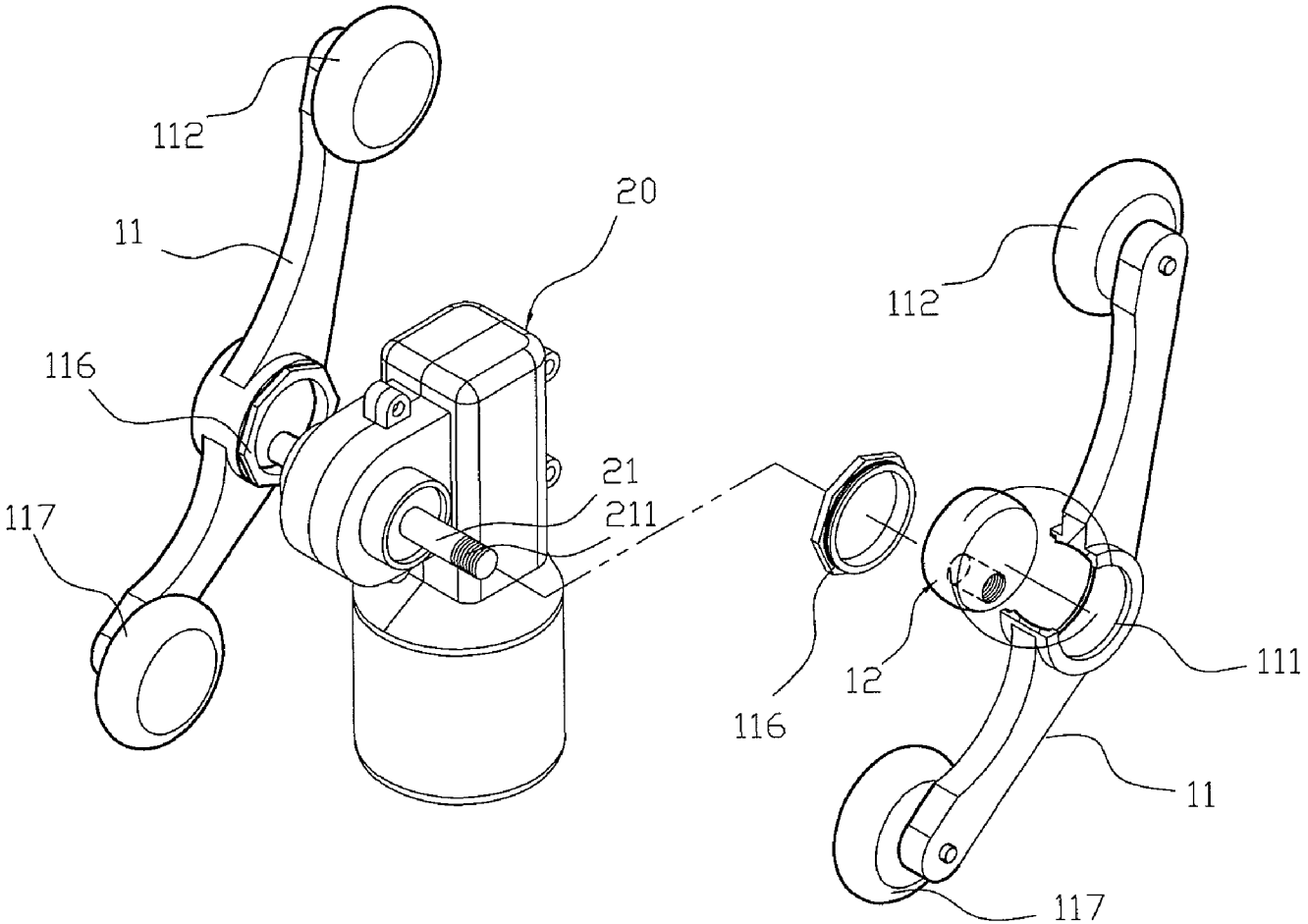
FIG. 5 is a partially exploded perspective view of a massaging device in accordance with another preferred embodiment of the present invention.
Figure 6:
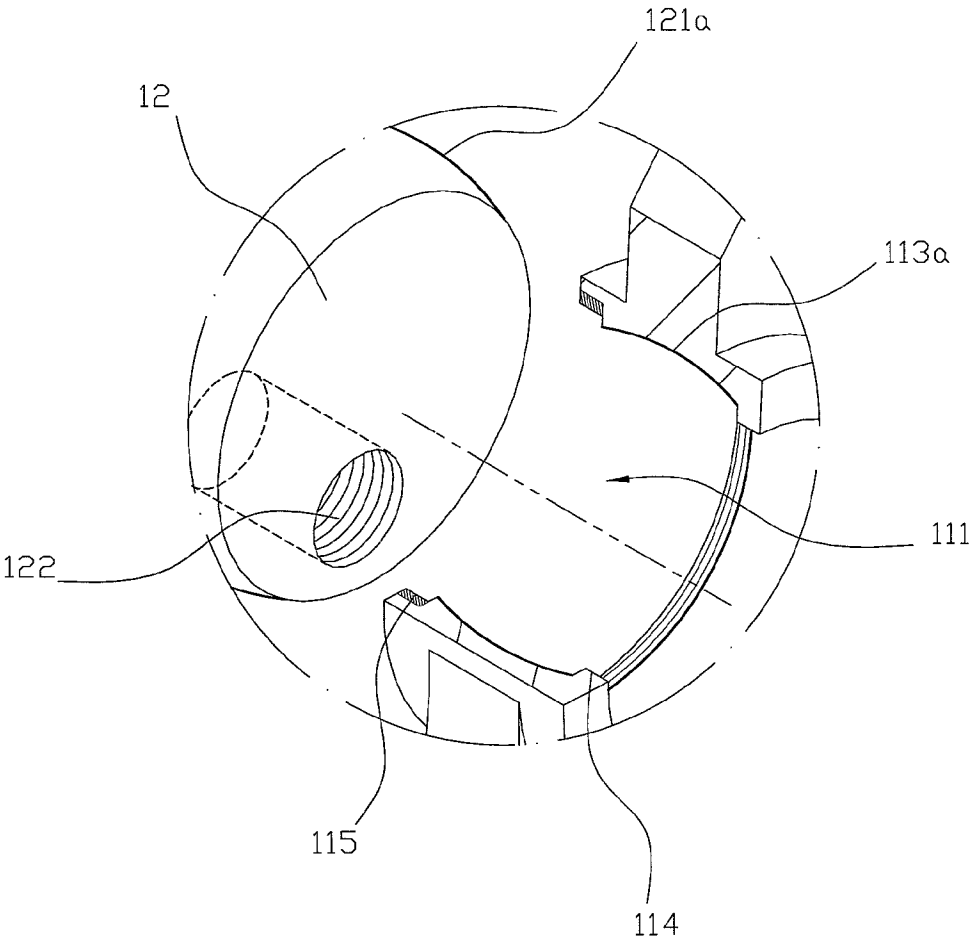
FIG. 6 is a locally enlarged cross-sectional view of the massaging device as shown in FIG. 5.
Figure 7:
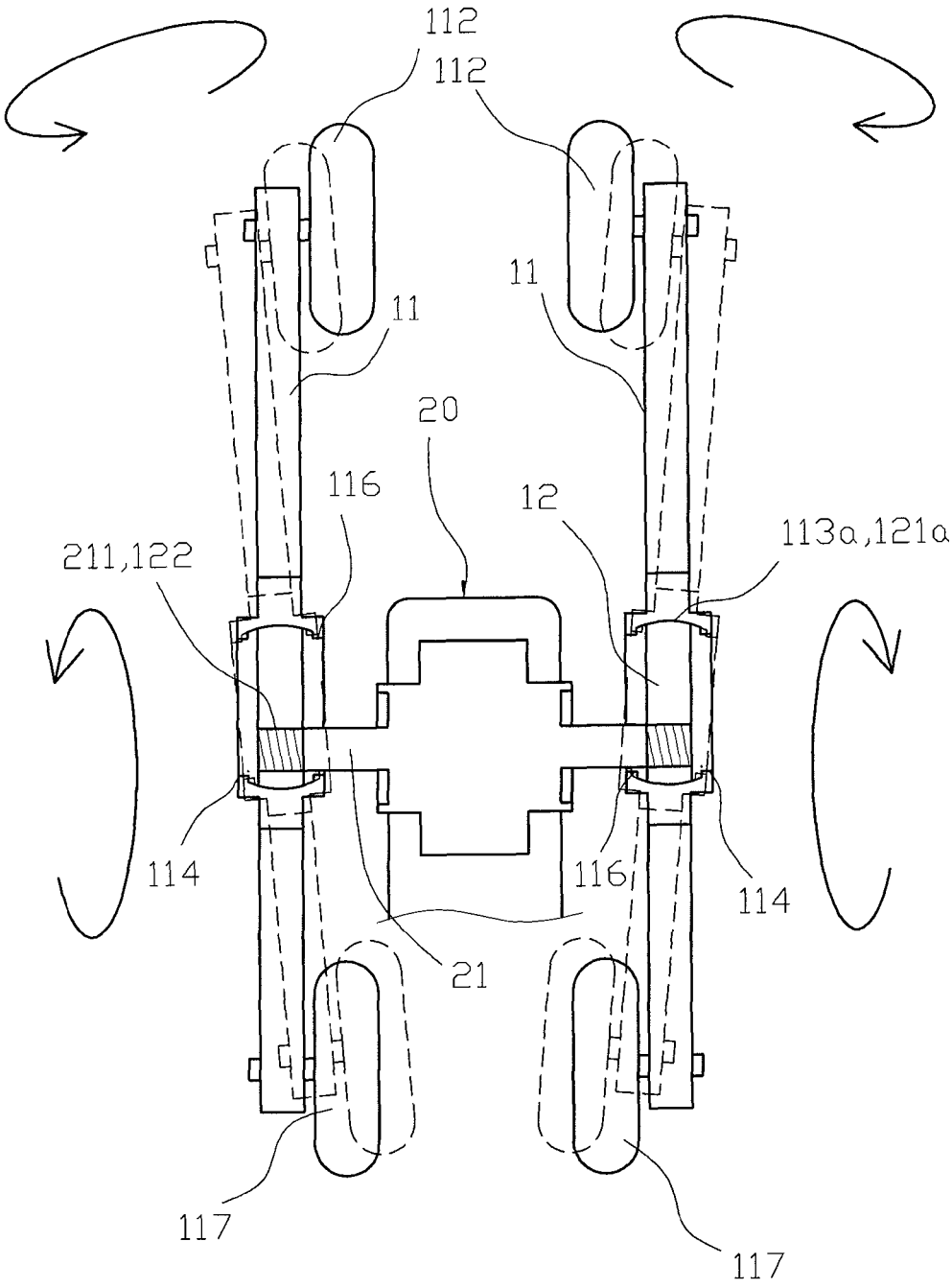
FIG. 7 is a front operational view of the massaging device as shown in FIG. 5 in use.

Referring to FIGS. 5-7, the sliding face 113*a* of the mounting hole 111 of each of the two swing arms 11 is a circular smooth concave face, and the resting face 121*a* of each of the two eccentric rotation members 12 is a circular smooth convex face, so that each of the two swing arms 11 swings sideward during the pivotal movement to enhance the massaging effect of the first massaging member 112 and the second massaging member 117 of each of the two swing arms 11.

Figure 8:
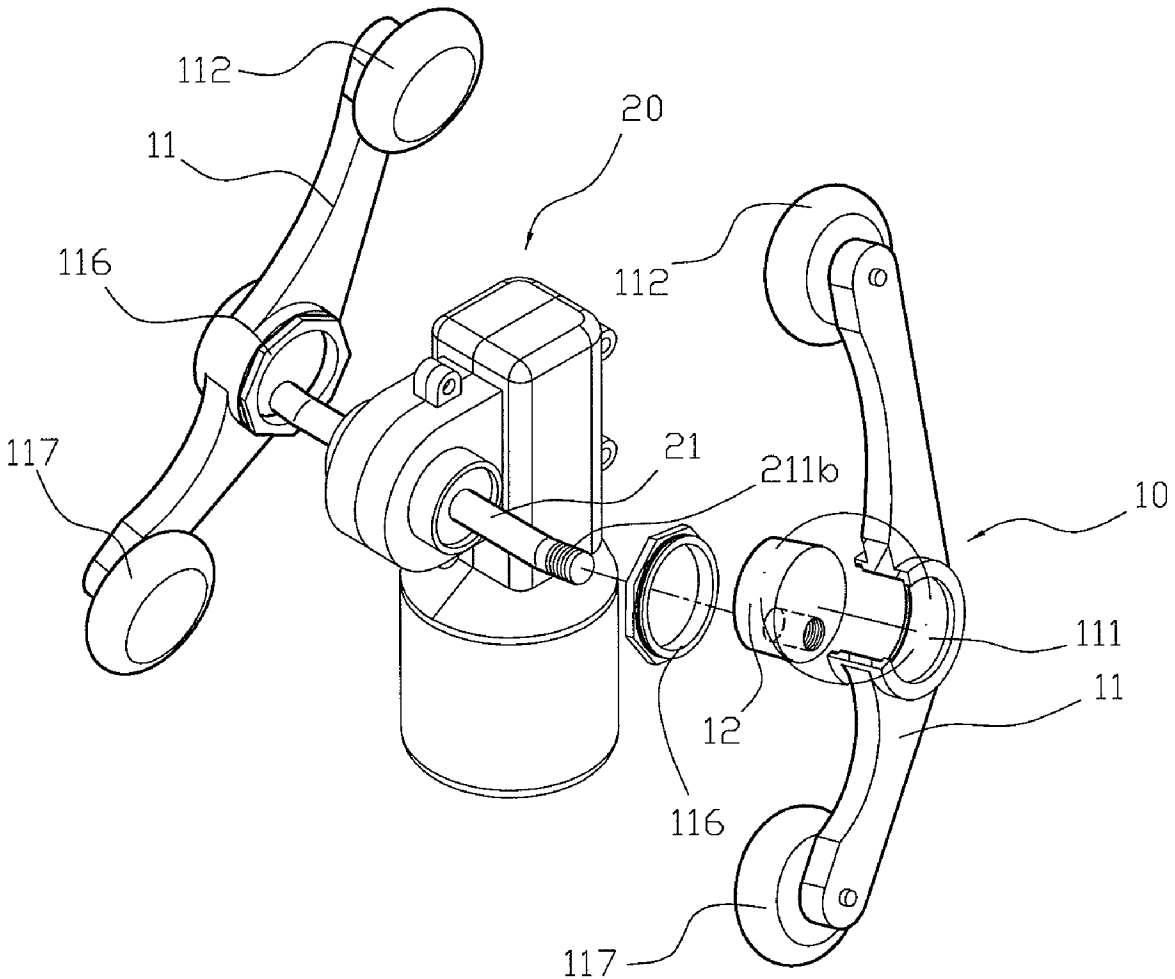
FIG. 8 is a partially exploded perspective view of a massaging device in accordance with another preferred embodiment of the present invention.
Figure 9:
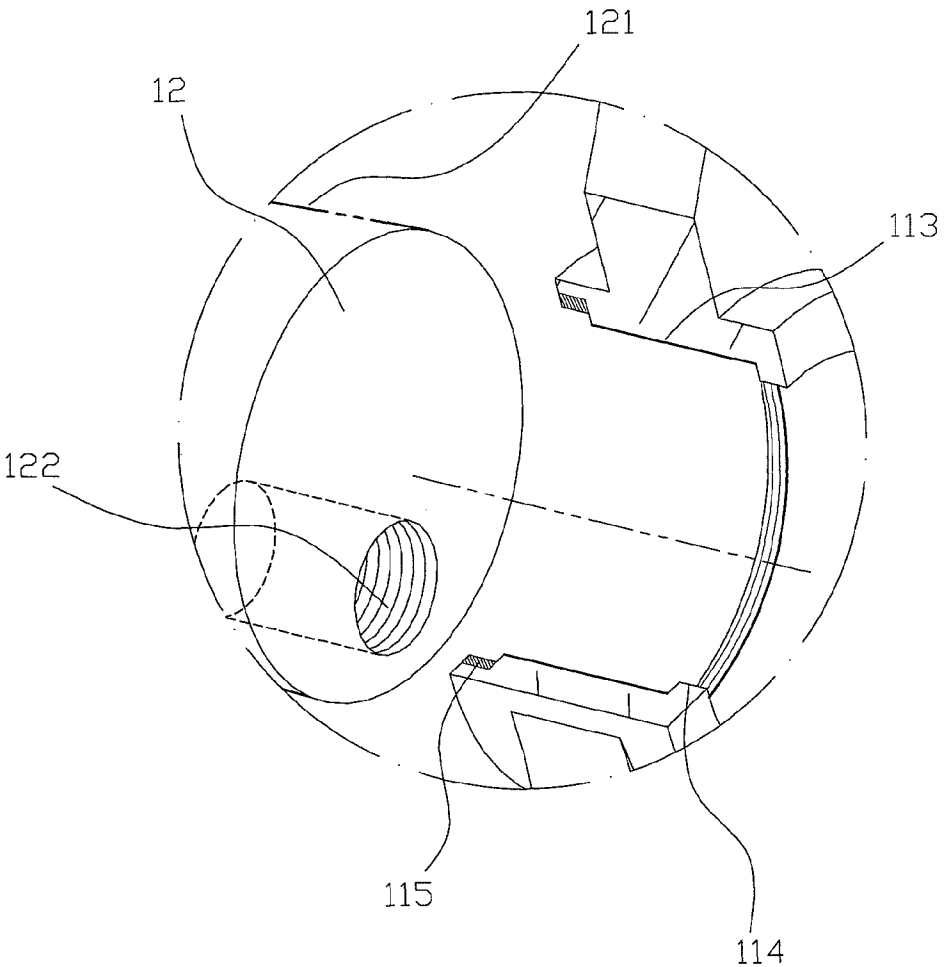
FIG. 9 is a locally enlarged cross-sectional view of the massaging device as shown in FIG. 8.
Figure 10:
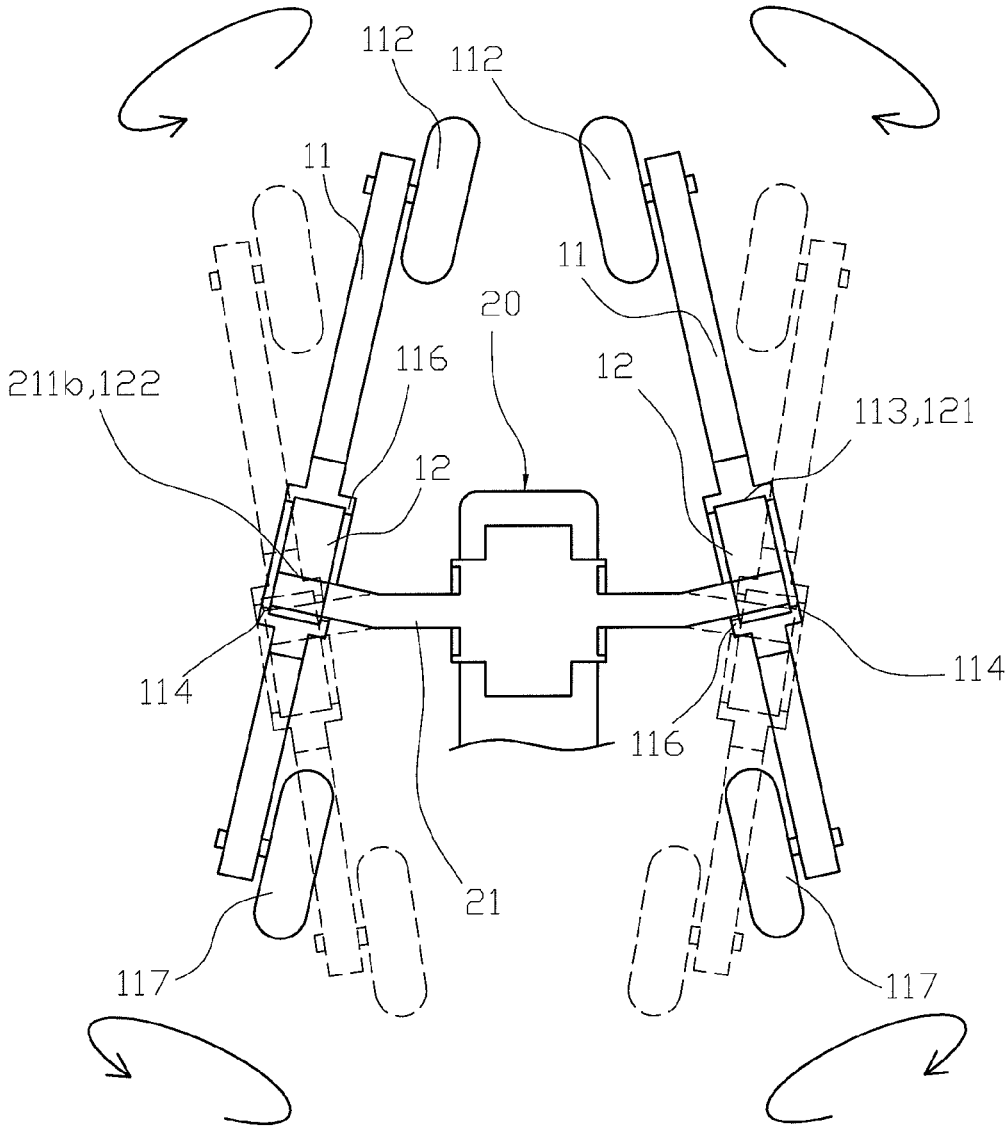
FIG. 10 is a front operational view of the massaging device as shown in FIG. 8 in use.
Figure 11:
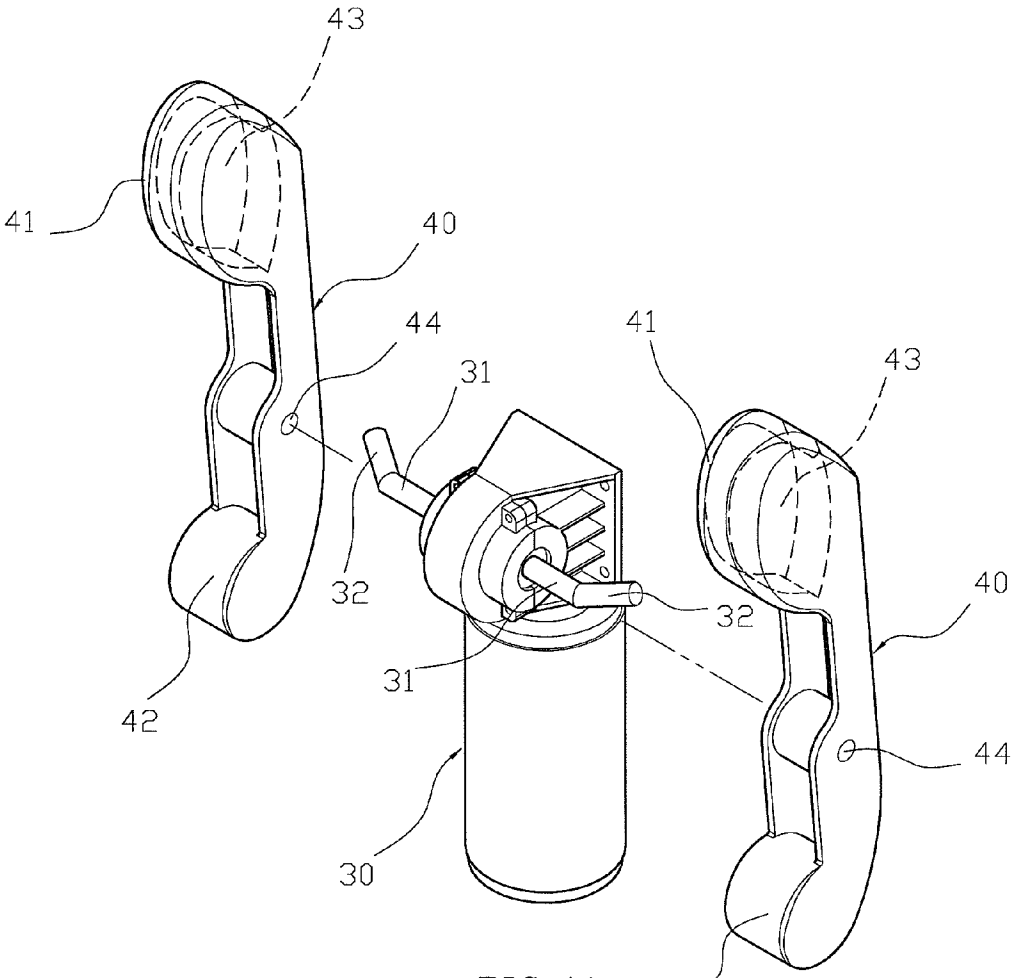
FIG. 11 PRIOR ART
FIG. 11 is an exploded perspective view of a conventional massaging device in accordance with the prior art.
Figure 12:
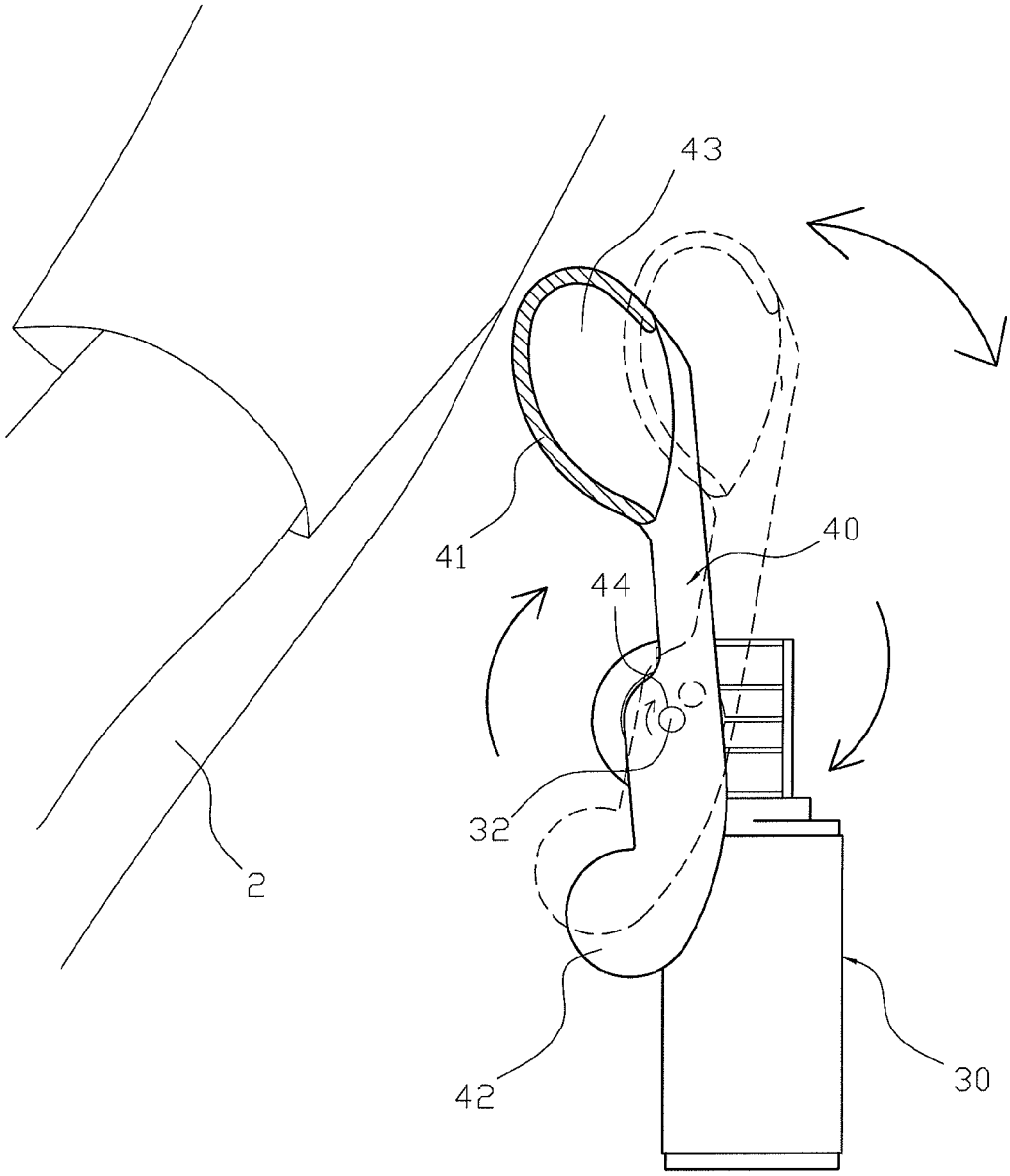
FIG. 12 PRIOR ART
FIG. 12 is a side operational view of the conventional massaging device as shown in FIG. 11 in use.

Referring to FIGS. 8-10, the drive portion 211*b* of the propeller shaft 21 of the driving mechanism 20 is inclined relative to and extends upward from the propeller shaft 21 of the driving mechanism 20, so that each of the two swing arms 11 swings sideward during the pivotal movement to enhance the massaging effect of the first massaging member 112 and the second massaging member 117 of each of the two swing arms 11.

Accordingly, the mounting hole 111 of each of the two swing arms 11 is pivotally mounted on the respective eccentric rotation member 12, so that each of the two swing arms 11 is movable reciprocally with the respective eccentric rotation member 12, and the first massaging member 112 and the second massaging member 117 of each of the two swing arms 11 are movable reciprocally to push, press and rub a user's body 1 so as to provide a massaging effect to the user's body 1. In addition, the sliding face 113 of the mounting hole 111 of each of the two swing arms 11 is in frictional sliding contact with the resting face 121 of the respective eccentric rotation member 12 to freely change and adjust the angle of each of the two swing arms 11. Further, when each of the two swing arms 11 is pressed by the user's body 1, the sliding face 113 of the mounting hole 111 of each of the two swing arms 11 is slidable on the resting face 121 of the respective eccentric rotation member 12 to freely adjust the angle of each of the two swing arms 11, so that the first massaging member 112 and the second massaging member 117 of each of the two swing arms 11 touch the user's body 1 evenly and exactly, and the pressing force applied by the first massaging member 112 and the second massaging member 117 of each of the two swing arms 11 are distributed evenly and smoothly on the user's body 1, thereby providing a comfortable sensation to the user. Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A massaging device, comprising:

two eccentric rotation members each having an inner portion provided with an eccentric hole and an outer portion provided with a resting face; and two swing arms each provided with a mounting hole which is pivotally mounted on a respective one of the two eccentric rotation members and has a peripheral wall provided with a sliding face which is in sliding contact with the resting face of the respective eccentric rotation member, wherein the mounting hole of each of the two swing arms has a first end provided with a radially and inwardly extending stop flange and a second end provided with a fixing portion for fixing a fixing member;

each of the two eccentric rotation members is retained between the stop flange and the fixing member of the respective swing arm.

2. The massaging device of claim 1, further comprising:

a driving mechanism provided with a propeller shaft which has two opposite ends each provided with a drive portion;

wherein the eccentric hole of each of the two eccentric rotation members is fixed on the respective drive portion of the propeller shaft of the driving mechanism.

3. The massaging device of claim 2, wherein the eccentric hole of each of the two eccentric rotation members is a screw bore.

4. The massaging device of claim 3, wherein the eccentric hole of each of the two eccentric rotation members is fixed on the respective drive portion of the propeller shaft of the driving mechanism by a threading engagement.

5. The massaging device of claim 2, wherein each of the two eccentric rotation members is fixed on and rotated by the propeller shaft of the driving mechanism.

6. The massaging device of claim 2, wherein the drive portion of the propeller shaft of the driving mechanism is in line and co-axial with the propeller shaft of the driving mechanism.

7. The massaging device of claim 2, wherein the drive portion of the propeller shaft of the driving mechanism is inclined relative to and extends upward from the propeller shaft of the driving mechanism.

8. The massaging device of claim 1, wherein the sliding face of the mounting hole of each of the two swing arms is a circular smooth flat face;

the resting face of each of the two eccentric rotation members is a circular smooth flat face.

9. The massaging device of claim 1, wherein the sliding face of the mounting hole of each of the two swing arms is a circular smooth concave face;

the resting face of each of the two eccentric rotation members is a circular smooth convex face.

10. The massaging device of claim 1, wherein the mounting hole of each of the two swing arms has a circular shape;

each of the two eccentric rotation members has a circular shape.

11. The massaging device of claim 1, wherein each of the two eccentric rotation members is a bearing.

12. The massaging device of claim 1, wherein the mounting hole of each of the two swing arms is located at a middle position of each of the two swing arms.

13. The massaging device of claim 12, wherein each of the two swing arms has a first end provided with a first massaging member and a second end provided with a second massaging member;

the mounting hole of each of the two swing arms is located between the first massaging member and the second massaging member.

14. The massaging device of claim 1, wherein the sliding face of the mounting hole of each of the two swing arms is located between the stop flange and the fixing portion.

15. The massaging device of claim 1, wherein the fixing portion of the mounting hole of each of the two swing arms is combined with the fixing member by a threading engagement.

16. The massaging device of claim 1, wherein each of the two eccentric rotation members is inserted through the fixing portion into the mounting hole of the respective swing arm.

17. The massaging device of claim 1, wherein the eccentric hole of each of the two eccentric rotation members is deflected from a central portion of each of the two eccentric rotation members.

18. The massaging device of claim 1, wherein each of the two eccentric rotation members is rotated about the eccentric hole in an eccentric manner.

19. The massaging device of claim 1, wherein the each of the two swing arms swings sideward during a pivotal movement.

* * * * *